US009019056B2

(12) United States Patent
An et al.

(10) Patent No.: US 9,019,056 B2
(45) Date of Patent: Apr. 28, 2015

(54) COIL COMPONENT, MOUNTING STRUCTURE THEREOF, AND ELECTRONIC DEVICE INCLUDING THE SAME

(75) Inventors: Duck Jin An, Gyunggi-do (KR); Ki Hung Nam, Gyunggi-do (KR); Soon Young Kwon, Gyunggi-do (KR); Myeong Sik Cheon, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 13/611,767

(22) Filed: Sep. 12, 2012

(65) Prior Publication Data

US 2014/0002224 A1 Jan. 2, 2014

(30) Foreign Application Priority Data

Jun. 29, 2012 (KR) ..... 10-2012-0070877

(51) Int. Cl.

| | |
|---|---|
| ***H01F 27/30*** | (2006.01) |
| ***H01F 27/29*** | (2006.01) |
| ***H01F 5/04*** | (2006.01) |
| ***H01F 5/02*** | (2006.01) |
| ***H01F 27/02*** | (2006.01) |
| *H01F 27/32* | (2006.01) |

(52) U.S. Cl.

CPC ..... *H01F 5/04* (2013.01); *H01F 27/325* (2013.01); *H01F 5/02* (2013.01); *H01F 27/32* (2013.01); *H01F 27/027* (2013.01); *H01F 27/306* (2013.01)

(58) Field of Classification Search

CPC ..... H01F 5/04; H01F 41/10; H01F 5/02; H01F 27/325; H01F 2005/043; H01F 27/38; H01F 27/29; H02K 2211/03; H02K 11/0073

USPC ..... 336/192, 196, 198, 199, 208

See application file for complete search history.

(56) References Cited

U.S. PATENT DOCUMENTS

| | | | | |
|---|---|---|---|---|
| 7,116,204 | B2 * | 10/2006 | Fushimi | 336/208 |
| 7,154,366 | B2 * | 12/2006 | Hsueh et al. | 336/198 |
| 7,456,719 | B2 * | 11/2008 | Suzuki et al. | 336/198 |

(Continued)

FOREIGN PATENT DOCUMENTS

| | | |
|---|---|---|
| JP | 2000-150258 A | 5/2000 |
| JP | 2011-151170 A | 8/2011 |

(Continued)

OTHER PUBLICATIONS

Korean Office Action issued in Application No. 10-2012-0070877 dated Sep. 11, 2013.

*Primary Examiner* — Alexander Talpalatski
*Assistant Examiner* — Joselito Baisa
(74) *Attorney, Agent, or Firm* — McDermott Will & Emery LLP

(57) ABSTRACT

Disclosed are a coil component capable of securing insulation between primary and secondary coils while being miniaturized, a mounting structure thereof, and an electronic device having the same. The coil component includes a bobbin including a winding part around which coils are wound and first terminal fastening parts fastened to a plurality of first connection terminals; and a second terminal fastening part including terminal blocks protruded from the bobbin and a plurality of second connection terminals fastened to the terminal blocks, wherein the second terminal fastening part is mounted on a substrate while being spaced apart from the bobbin after the coils are wound therearound.

16 Claims, 11 Drawing Sheets

(56) References Cited

U.S. PATENT DOCUMENTS

| | | | | |
|---|---|---|---|---|
| 7,830,234 | B1 * | 11/2010 | Tien et al. | 336/208 |
| 7,928,822 | B2 * | 4/2011 | Suzuki et al. | 336/198 |
| 8,564,396 | B2 * | 10/2013 | Pan | 336/222 |
| 2012/0038448 | A1 | 2/2012 | Kim et al. | |
| 2012/0280780 | A1 * | 11/2012 | Cheng et al. | 336/212 |

FOREIGN PATENT DOCUMENTS

| | | | |
|---|---|---|---|
| JP | 2012-15526 | A | 1/2012 |
| KR | 2010-023313 | A | 11/2010 |
| KR | 20120025377 | A | 3/2012 |

* cited by examiner

COIL COMPONENT, MOUNTING STRUCTURE THEREOF, AND ELECTRONIC DEVICE INCLUDING THE SAME

CROSS-REFERENCE TO RELATED APPLICATIONS

This application claims the priority of Korean Patent Application No. 10-2012-0070877 filed on Jun. 29, 2012, in the Korean Intellectual Property Office, the disclosure of which is incorporated herein by reference.

BACKGROUND OF THE INVENTION

1. Field of the Invention

The present invention relates to a coil component and an electronic device having the same, and more particularly, to a coil component capable of securing insulation properties between primary and secondary coils while being miniaturized, a mounting method thereof, and an electronic device including the same.

2. Description of the Related Art

Recently, as various electronic devices have been miniaturized and slimmed, an effort to reduce a height or a mounting area of a case thereof, even in a coil component used for electronic devices, has been demanded.

However, in the case that the coil component is miniaturized, it may be difficult to satisfy requirements for insulating performance or to secure an insulating distance regulated by safety standards, and the like, based on domestic and international laws.

In case of the related art, a coil component in which primary and secondary coils are sequentially wound around a single bobbin and a core is coupled to the bobbin has mainly been used.

However, in the case of a small coil component, it may be difficult to secure a sufficient insulating distance between a primary side external connection terminal and a secondary side external connection terminal due to a small bobbin size.

To this end, in the case of the related art, a method of extracting coils so as to be disposed distantly from the bobbin by connecting insulated wires to the secondary coil without using an external connection terminal on the secondary side, has been used.

However, in the coil component according to the related art, the secondary side is configured of wires (that is, insulated wires) without an external connection terminal, and therefore, the coil component is not fixed.

Therefore, there are problems in that the coil component cannot be easily mounted or handled and that coil components should be mounted manually. Further, the wires, which may act as obstacles to auto winding, are not fixed at the time of winding working.

RELATED ART DOCUMENT

Japanese Patent Laid-Open Publication No. 2011-151170

SUMMARY OF THE INVENTION

An aspect of the present invention provides a coil component capable of securing insulation between primary and secondary coils while allowing for the miniaturization thereof, and an electronic device having the same.

Another aspect of the present invention provides a miniaturized coil component capable of being automatically wound, and an electronic device having the same.

Another aspect of the present invention provides a method of mounting a coil component on a substrate by separating external connection terminals from bobbin after winding of the coils, and an electronic device having the same.

According to an aspect of the present invention, there is provided a coil component, including: a bobbin including a winding part around which coils are wound and first terminal fastening parts fastened to a plurality of first connection terminals; and a second terminal fastening part including terminal blocks protruded from the bobbin and a plurality of second connection terminals fastened to the terminal blocks, wherein the second terminal fastening part is separated from the bobbin after the coils are wound.

The second terminal fastening part may include an auxiliary winding part connecting the terminal blocks to the bobbin, and the auxiliary winding part may have the coils wound therearound to electrically connect the bobbin to the second connection terminals when the second terminal fastening part is spaced apart from the bobbin.

The auxiliary winding part may have a reduced cross sectional area toward the bobbin.

The second terminal fastening part may include at least one support protrusion protruded from the terminal blocks to space a substrate and the terminal blocks apart from each other when the second terminal fastening part is mounted on the substrate.

The support protrusions may be disposed between the second connection terminals.

The terminal blocks may be provided with at least one guide groove to guide the coils to the second connection terminals.

The terminal blocks may include at least one winding groove around which the coils are wound at least once to prevent a movement of the coils wired to the second connection terminals when the second terminal fastening part is spaced apart from the bobbin.

The bobbin may include at least one locking protrusion protruded from a position adjacent to the second terminal fastening part, supporting the coils wired to the second terminal fastening part, and extending a path of the coils.

The second terminal fastening part may be integrally manufactured with the bobbin and may be cut with external pressure to be separated from the bobbin.

A portion in which the second terminal fastening part and the bobbin are connected to each other may be provided with at least one cutting groove and may be formed to have a cross sectional area smaller than those of portions adjacent to the cutting groove.

The second terminal fastening part may be separately manufactured from the bobbin to be coupled to the bobbin.

Any one of the second terminal fastening part and the bobbin may include at least one locking protrusion protruded to the outside and the other thereof may include at least one joining groove, and the second terminal fastening part and the bobbin may be coupled to each other by inserting the locking protrusion into the joining groove.

The second terminal fastening part may be protruded from the first terminal fastening part of the bobbin.

The winding part may be formed of a tubular body part and flange parts extended from both edges of the body part, and the second terminal fastening part may be protruded from any one of the flange parts.

According to another aspect of the present invention, there is provided a coil component including: a bobbin including a winding part around which coils are wound and first terminal fastening parts fastened to a plurality of first connection terminals; and a second terminal fastening part including terminal blocks with which second connection terminals are fastened and an auxiliary winding part connecting the terminal blocks to the bobbin, wherein an outside of the auxiliary winding part is wound with a portion of the coils.

The second terminal fastening part may be separated from the bobbin and then, may be mounted on the substrate while being spaced apart from the bobbin.

According to another aspect of the present invention, there is provided a mounting structure for a coil component, including: a substrate; and a coil component including a bobbin that includes a winding part around which a plurality of coils are wound and first terminal fastening parts fastened to a plurality of first connection terminals, the bobbin being mounted on the substrate, and a second terminal fastening part mounted on the substrate while being spaced apart from the bobbin by a predetermined distance, wherein at least one of the coils is electrically connected to the substrate through the second terminal fastening part.

According to another aspect of the present invention, there is provided an electronic device, including: a substrate; and a coil component including a bobbin that includes a winding part around which a plurality of coils are wound and first terminal fastening parts fastened to a plurality of first connection terminals, the bobbin being mounted on the substrate, and a second terminal fastening part mounted on the substrate while being spaced apart from the bobbin by a predetermined distance, wherein at least one of the coils is electrically connected to the substrate through the second terminal fastening part.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENT

Figure 1:
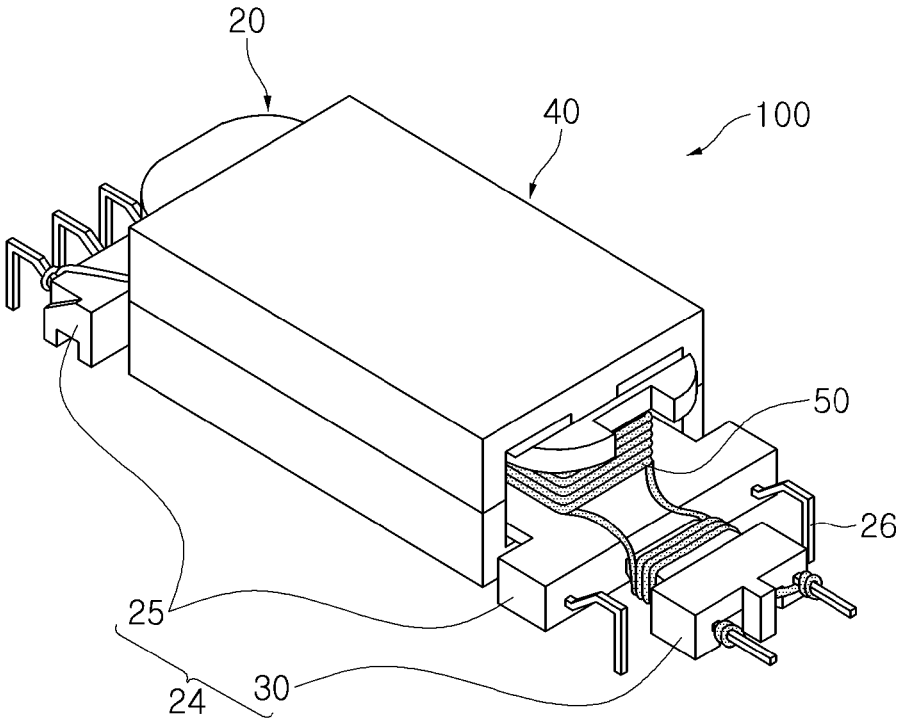
FIG. 1 is a perspective view schematically showing a coil component according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

Figure 2:
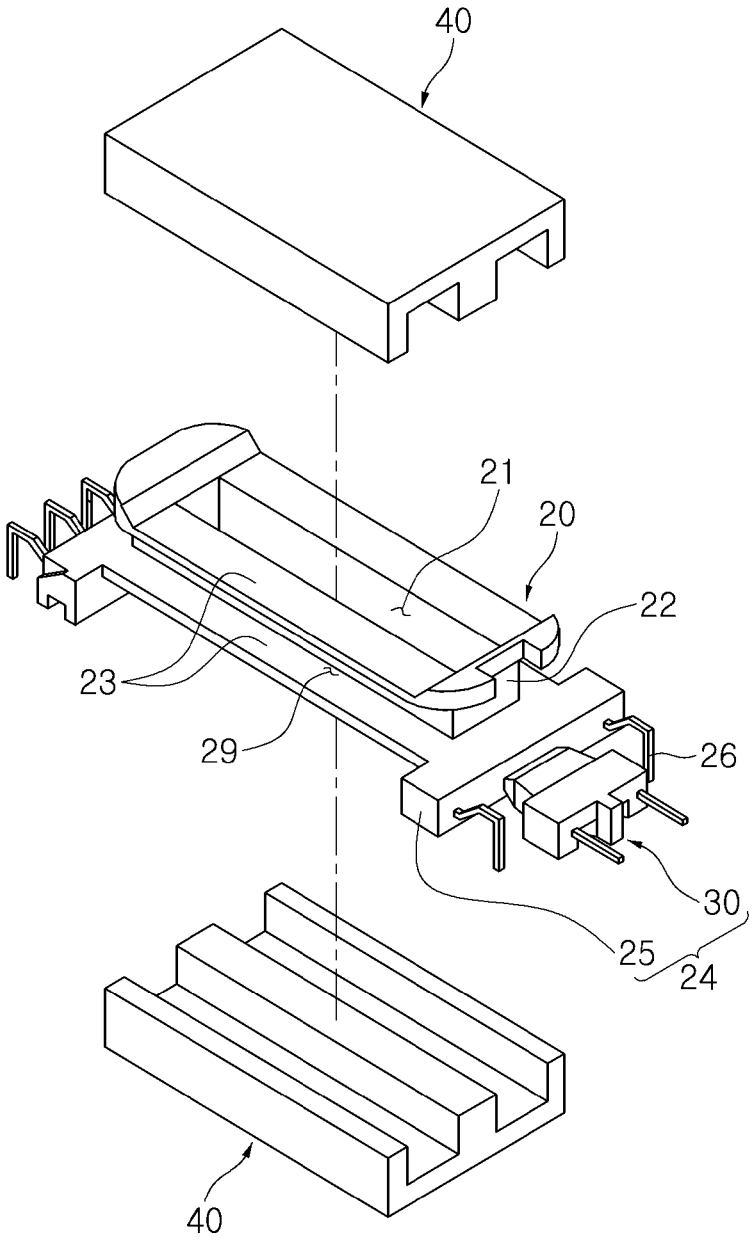
FIG. 2 is an exploded perspective view of the coil component shown in FIG. 1.
Figure 3:
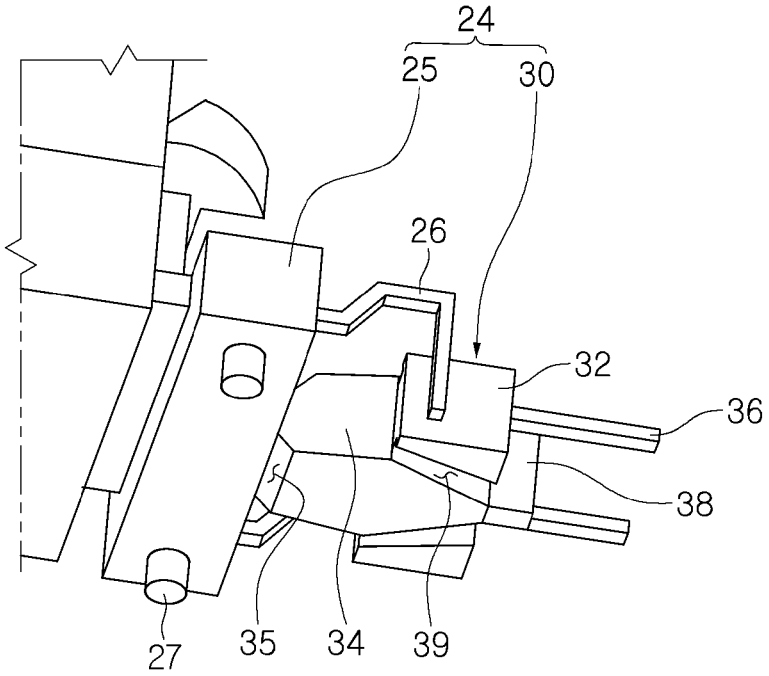
FIG. 3 is a partial bottom perspective view of the coil component shown in FIG. 1.
Figure 4:
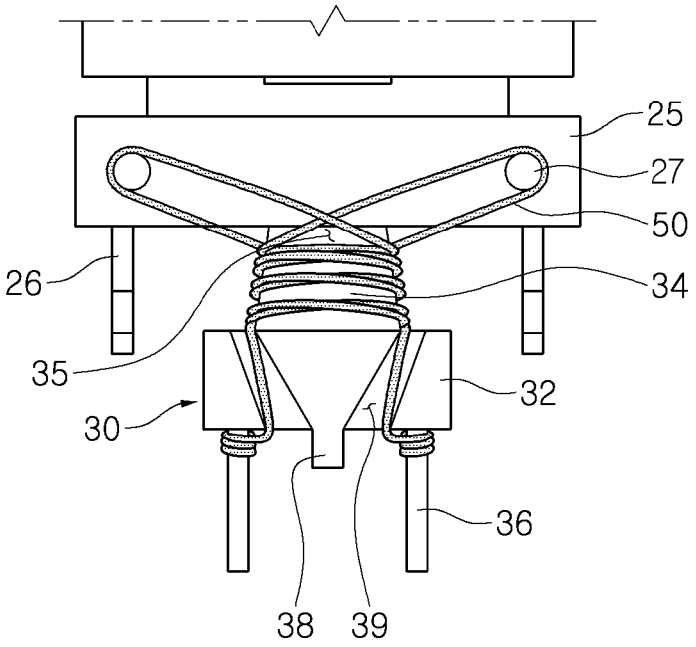
FIG. 4 is a partial bottom view of the coil component shown in FIG. 1.

FIG. 1 is a perspective view schematically showing a coil component according to an embodiment of the present invention and FIG. 2 is an exploded perspective view of the coil component shown in FIG. 1. FIG. 3 is a partial bottom perspective view of the coil component shown in FIG. 1 and FIG. 4 is a partial bottom view of the coil component shown in FIG. 1. Herein, FIGS. 2 and 3 show a coil component in which coils are omitted for convenience of explanation.

Referring to FIGS. 1 through 4, a coil component 100 according to an embodiment of the present invention may be a small transformer and may be configured to include coils 50, a bobbin 20, and a core 40.

The coils 50 may include a primary coil and a secondary coil.

The primary coil and the secondary coil may be wound around a winding part 29 formed around the bobbin 20 to be described below. Here, the secondary coil may be wound around the winding part 29 of the bobbin 20 on the primary coil in a stacked manner. On the other hand, the secondary coil may be wound first and then the primary coil may be wound on the secondary coil to be stacked thereon.

In addition, the primary coil and the secondary coil according to the embodiment of the present invention may be configured so that a plurality of coils electrically insulated therebetween are wound around the winding part 29. That is, the coil component 100 according to the embodiment of the present invention may apply various kinds of voltage thereto by configuring the primary coil formed of the plurality of coils and may extract various voltages through the secondary coil corresponding thereto.

To this end, respective coils configuring the primary coil or the secondary coil may be configured to have different thicknesses and different winding number. In addition, as the coils 50, a strand of wire may be used and a Ritz wire formed by twisting several strands may be used.

Lead lines of the coils 50 are connected to first connection terminals 26 provided with the bobbin 20 and terminal pins 36.

As shown in FIG. 2, the bobbin 20 may include a tubular body part 22 having a through hole 21 formed in an inner center thereof, flange parts 23 formed on the body part 22, and a terminal fastening part 24 connecting the first connection terminals 26 to the second connection terminals 36 through which the coils 50 are electrically and physically connected with the outside.

The through hole 21 formed in the body part 22 is used as a path into which a portion of the core 40 is inserted. The embodiment of the present invention describes a case in which a cross section of the through hole 21 is formed to have a quadrangular shape by way of example. This is configured according to the shape of the core 40 inserted into the through hole 21, and the bobbin 20 according to the embodiment of the present invention is not limited thereto. Therefore, the through hole 21 may be formed to have various shapes as necessary, corresponding to the shape of the core 40 inserted into the through hole 21.

The flange parts 23 may be formed to be extended in an outer diameter direction from both edges of the body part 22.

Therefore, a space formed between an outer circumferential surface of the body part 22 and inner sides of the flange parts 23 is used as the winding part 29 around which the coils 50 are wound.

The flange parts 23 serves to protect the coils 50 from the outside and secure the insulation between the coils 50 and the outside, while supporting the coils 50 wound around the winding part 29 at both sides thereof.

The terminal fastening part 24 may be extended from the flange parts 23 of the bobbin 20.

In more detail, the terminal fastening part 24 may be protruded from the flange parts 23 to the outside in the outer diameter direction.

In particular, the terminal fastening part 24 according to the embodiment of the present invention may include first terminal fastening parts 25 and a second terminal fastening part 30.

The first terminal fastening parts 25 may be disposed under the winding part 29. In the case of the embodiment of the present invention, the first terminal fastening parts 25 may be protruded to be extended downwardly from the flange parts 23. Therefore, the first terminal fastening parts 25 may be provided with two flange parts 23, respectively.

In addition, ends of the first terminal fastening parts 25 are fastened to at least one first connection terminal 26. The first connection terminal 26 may be fastened thereto in a form in which it is protruded from the bobbin 20 to the outside.

Meanwhile, the first terminal fastening parts 25 may include at least one locking protrusion 27 formed on one surface thereof.

As shown in FIG. 4, the locking protrusions 27 may be protruded at a position adjacent to the second terminal fastening part 30, support the coils 50 wired to the second terminal fastening part 30 to be described below, and allow for a path of the coils 50 to be extended.

In the embodiment of the present invention, the cylindrical locking protrusions 27 are formed on the lower surfaces of the first terminal fastening parts 25, wherein two of the cylindrical locking protrusions 27 are disposed to be spaced apart from each other by a predetermined distance.

The coils 50 connected to the second terminal fastening part 30 from the bobbin 20 may be lengthily extended by the locking protrusions 27. In addition, the coils 50 extended by the locking protrusions 27 are released from the locking protrusions 27 when the second terminal fastening part 30 is separated from the bobbin 20, thereby electrically connecting between the bobbin 20 and the second terminal fastening part 30.

Therefore, the position, size, shape, number, and the like, of locking protrusions 27 according to the embodiment of the present invention are not limited to the above configuration when the locking protrusions 27 may easily lock the coils 50.

The second terminal fastening part 30 may have the plurality of second connection terminals 36 fastened to an end thereof. In addition, the second terminal fastening part 30 may be disposed anywhere in which the second terminal fastening part 30 may be exposed to the outside of the core.

In the case of the embodiment of the present invention, the second terminal fastening part 30 may be formed to protrude from the first terminal fastening parts 25 to the outside. However, the configuration of the embodiment of the present invention is not limited thereto.

That is, the second terminal fastening part 30 may be disposed on the first terminal fastening parts 25, the flange parts 23, and the like, but may be disposed anywhere in which the coils 50 may be easily wired to the second connection terminals 36 of the second terminal fastening part 30 and after the coils 50 are wound therearound, may be easily separated.

The second terminal fastening part 30 according to the embodiment of the present invention is separated from the bobbin 20 so as to be spaced apart from the bobbin 20 when the coil component 100 is mounted on a substrate 90.

To this end, the second terminal fastening part 30 may be configured to include terminal blocks 32, the second connection terminals 36, and an auxiliary winding part 34.

The terminal blocks 32 may be fastened to the second connection terminals 36. Further, the terminal blocks 32 may be provided with at least one guide groove 39 that guides the coils 50 to the second connection terminals 36. The guide grooves 39 may be formed on at least any one of the terminal blocks 32 and may be formed in plural, corresponding to the second connection terminals 36. However, the embodiment of the present invention is not limited thereto and therefore, various applications may be implemented as needed, such as forming only one guide groove 39 having a relatively wide width, and the like.

In addition, the terminal blocks 32 may be provided with at least one support protrusion 38. The support protrusion 38 according to the embodiment of the present invention may be protruded from the terminal block 32 between the first connection terminals 26 in the same direction as a direction in which the first connection terminals 26 are protruded.

The support protrusion 38 is provided to prevent a short circuit from occurring between the second connection terminals 36 due to the flowing of the melted solder between the terminal blocks 32 and the substrate 90, when the second terminal fastening part 30 is mounted on the substrate 90 by a solder, and the like. Therefore, the support protrusion 38 is protruded shorter than the second connection terminals 36 to support the substrate 90 and space the terminal blocks 32 and the substrate 90 apart from each other by a predetermined distance, when the second terminal fastening part 30 is mounted on the substrate 90.

The auxiliary winding part 34 connects the terminal blocks 32 to the bobbin 20, that is, the first terminal fastening parts 25.

In addition, the auxiliary winding part 34 may have a portion of the coils 50 to be wound therearound. Therefore, a corner portion of the auxiliary winding part 34 may be chamfered or formed to have a curved surface to prevent the coils 50 from being folded at the corner portion.

Further, the auxiliary winding part 34 is formed to have a smaller width (or a smaller thickness) than those of the terminal blocks 32, such that a portion at which the auxiliary winding part 34 is connected to the terminal blocks 32 may be provided with steps. Therefore, the coils 50 wound around the auxiliary winding part 34 may maintain a state in which the coils 50 are wound around the auxiliary winding part 34 without being separated to the outside of the terminal blocks 32 due to the steps.

In addition, the auxiliary winding part 34 may be formed to have a gradually reduced shape in a cross sectional area thereof toward the bobbin 20. That is, the auxiliary winding part 34 has a form in which a cross sectional area of a portion at which the auxiliary winding part 34 is adjacent to the terminal block 32 becomes relatively largest and a cross sectional area of a portion at which the auxiliary winding part 34 is connected to the first terminal fastening part 25 becomes relatively smallest.

By this configuration, when the second terminal fastening part 30 is separated from the first terminal fastening parts 25, the coils 50 wound around the auxiliary winding part 34 may be released while easily exiting to the outside from the auxiliary winding part 34. Therefore, the second terminal fastening part 30 may be separated from the bobbin 20 by a distance corresponding to a length of the coils 50 that are released from the auxiliary winding part 34.

Meanwhile, in the case of the embodiment of the present invention, the second terminal fastening part 30 is separated from the bobbin 20 by cutting a portion at which the second terminal fastening part 30 is connected to the first terminal fastening parts 25 by applying external pressure, that is, force thereto.

Referring to FIG. 3, a connection portion between the second terminal fastening part 30 and the first terminal fastening part 25 is more concavely formed than at portions adjacent to a cutting groove 35, such that the connection portion is configured to have a smaller cross section than that of the auxiliary winding part 34. Therefore, the portion at which the second terminal fastening part 30 is connected to the first terminal fastening parts 25 may be easily cut with the external pressure.

The bobbin 20 according to the embodiment of the present invention configured as described above may be easily manufactured by injection molding, but the present invention is not limited thereto. Therefore, the bobbin 20 may be manufactured by various methods such as press working, and the like. In addition, the bobbin 20 according to the embodiment of the present invention may be formed of an insulating resin and formed of materials having high heat resistance and high voltage resistance. As materials forming the bobbin 20, polyphenylene sulfide (PPS), liquid crystalline polyester (LCP), polybutylene terephthalate (PBT), polyethylene terephthalate (PET), phenolic resin, and the like, may be used.

The core 40 is partially inserted into the through hole 21 formed in the bobbin 20 to form a magnetic path. The core 40 according to the embodiment of the present invention is configured in a pair. A pair of the cores 40 may be each inserted through the through hole 21 of the bobbin 20 and thus, may be fastened so as to face each other.

As the core 40 according to the embodiment of the present invention, an 'EE' core may be used. That is, two 'E' type cores having the same size and shape may be coupled to each other.

The cores 40 may be formed of Mn—Zn-based ferrite having relatively higher permeability, relatively low loss, relatively high saturation magnetic flux density, high stability, and lower production cost, as compared with other materials. However, in the embodiment of the present invention, the shape or materials of the core 40 are not limited thereto.

In the coil component 100 according to the embodiment of the present invention configured as described above, the coils 50 are wound around the bobbin 20 in the state in which the second terminal fastening part 30 is integrally formed with the bobbin 20. Further, the lead wires of the wound coils 50 are wired to the first connection terminals 26 of the first terminal fastening parts 25 and the second connection terminals 36 of the second terminal fastening part 30, respectively.

Here, the coils (hereinafter, first coils) wired to the first connection terminals 26 of the first terminal fastening parts 25 may be immediately extracted from the winding part 29 and directly wired to the first connection terminals 26.

On the other hand, the coils (hereinafter, a second coil) wired to the second connection terminals 36 of the second terminal fastening part 30 are wound around the auxiliary winding part 34 of the second terminal fastening part 30, plural times, and then, are wired to the second connection terminals 36 via the guide groove 39 of the terminal blocks 32.

As described above, when the bobbin 20 and the second terminal fastening part 30 are separated from the first terminal fastening parts 25, the second terminal fastening part 30 may be separated from the bobbin 20 by the length of the coils 50 wound around the auxiliary winding part 34. Therefore, the winding number of the coils 50 wound around the auxiliary winding part 34 may be set to correspond to a distance that the second terminal fastening part 30 is spaced apart from the bobbin 20.

In addition, in the coil component 100 according to the embodiment of the present invention, the locking protrusions 27 formed at the first terminal fastening parts 25 may be used in a case in which it is difficult to sufficiently space the second terminal fastening part 30 apart from the bobbin 20 only by the distance of the coils 50 wound around the auxiliary winding part 34. That is, as shown in FIG. 4, in the coil component 100 according to the embodiment of the present invention, the second coil 50 is wound around the auxiliary winding part 34 and supports the locking protrusions 27 and may be wound to the first terminal fastening part 25 side at least once. Therefore, a spaced distance of the second terminal fastening part 30 may be easily controlled.

Due to the configuration described above, in the coil component 100 according to the embodiment of the present invention, the second terminal fastening part 30 cut from the bobbin 20 may be mounted on the substrate while being spaced apart from the bobbin 20 by a predetermined distance (the insulating distance between the primary and secondary coils, or more). Therefore, even in a case in which the coil component 100 is manufactured to have a relatively small size, the insulating distance between the primary and secondary coils may easily be secured.

Meanwhile, the coil component according to the embodiment of the present invention is not limited thereto, and therefore, various applications may be implemented.

Embodiments of the present invention to be described below have a similar configuration to the foregoing embodiments of the present invention and the main difference between the embodiments is the configuration of the second terminal fastening part. Therefore, the detailed description of the same components as the foregoing embodiments of the present invention will be omitted and the configuration of the second terminal fastening part having the difference will be mainly described.

Figure 5A:
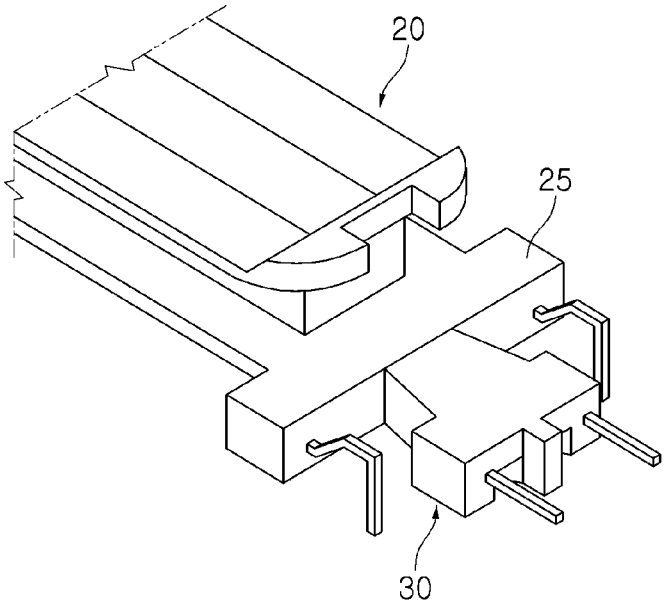
FIG. 5A is a perspective view showing a bobbin according to another embodiment of the present invention.
Figure 5B:
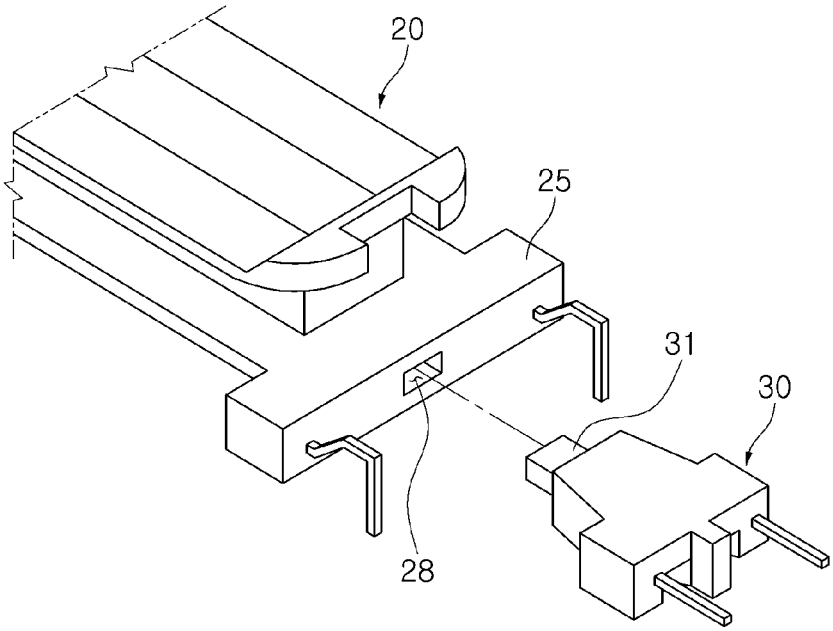
FIG. 5B is a perspective view showing a state in which a second terminal fastening part is separated from the bobbin of FIG. 5A.

FIG. 5A is a perspective view showing a bobbin according to another embodiment of the present invention and FIG. 5B is a perspective view showing a state in which a second terminal fastening part is separated from the bobbin of FIG. 5A.

Referring to FIGS. 5A and 5B, in the coil component according to the embodiment of the present invention, the second terminal fastening part 30 is separately manufactured without being integrally manufactured with the bobbin 20 and is thus coupled to the bobbin 20. That is, the second terminal fastening part 30 according to the embodiment of the present invention coupled to the bobbin 20 through assembling therebetween.

To this end, the second terminal fastening part 30 may include at least one locking protrusion 31 and the bobbin 20 may include at least one joining groove 28 into which the locking protrusion 31 of the second terminal fastening part 30 are inserted. Therefore, the joining groove 28 and the locking protrusion 31 may be formed to have a shape and a size corresponding to each other so that the joining groove 28 and the locking protrusion 31 are firmly coupled to each other.

In addition, when the bobbin 20 and the second terminal fastening part 30 are configured in an assembling scheme as in the embodiment of the present invention, the second terminal fastening part 30 may be easily separated from the bobbin 20 even when the second terminal fastening part 30 is not cut. Therefore, there is no need to apply an excessive force to the bobbin 20 in order to cut the second terminal fastening part 30, such that the damage of the bobbin 20 or the coil may be significantly reduced during the process of separating the second terminal fastening part 30.

In the embodiment of the present invention describes, the case in which the joining groove 28 is formed in a side of the first terminal fastening part 25 is described by way of example. However, the present invention is not limited thereto and therefore, the joining groove may be formed in various positions, when necessary.

Figure 6A:
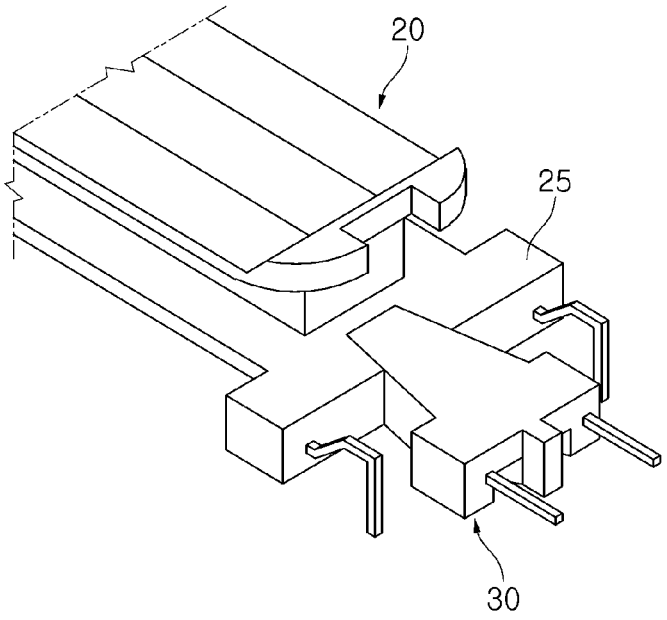
FIG. 6A is a perspective view showing a bobbin according to another embodiment of the present invention.
Figure 6B:
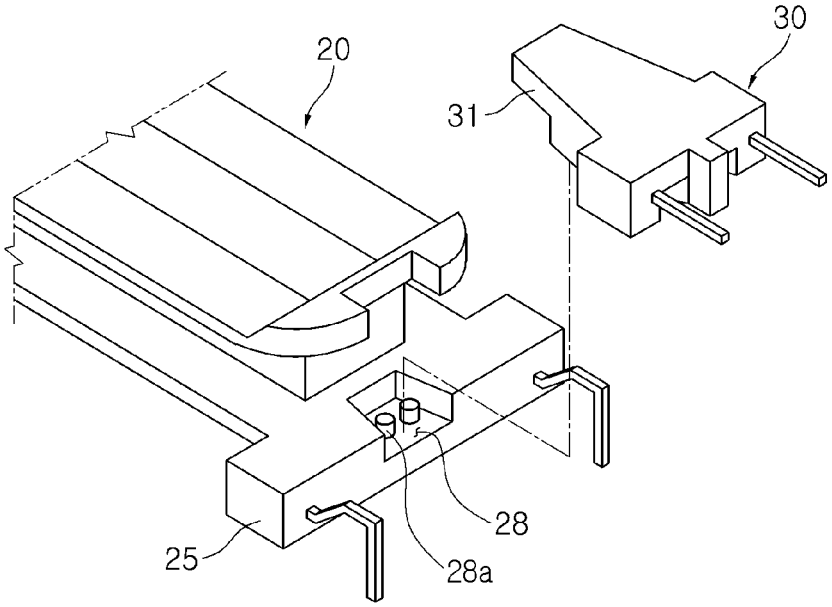
FIG. 6B is a perspective view showing a state in which the second terminal fastening part is separated from the bobbin of FIG. 6A.

FIG. 6A is a perspective view showing a bobbin according to another embodiment of the present invention and FIG. 6B is a perspective view showing a state in which the second terminal fastening part is separated from the bobbin of FIG. 6A.

Referring to FIGS. 6A and 6B, even in the coil component according to the embodiment of the present invention, the second terminal fastening part 30 is separately manufactured without being integrally manufactured with the bobbin 20 and is thus coupled to the bobbin 20 through assembling therebetween, similar to the embodiment of the present invention shown in FIG. 5A. That is, the second terminal fastening part 30 according to the embodiment of the present invention is coupled to the bobbin 20 and there is a difference with respect to only the coupling scheme.

In the coil component according to the embodiment of the present invention, the first terminal fastening part 24 of the bobbin 20 is provided with the joining groove 28. The joining groove 28 is formed in a groove having a form in which the top portion and the side, that is, two adjacent surfaces are opened. Further, the second terminal fastening part 30 is provided with the locking protrusion 31 inserted into the joining groove 28.

In addition, in order to firmly couple the bobbin 20 and the second terminal fastening part 30, at least one fitting protrusion 28*a* may be formed within the joining groove 28. In addition, at least one fitting groove (not shown) into which the fitting protrusions 28*a* are inserted may be formed within the locking protrusion 31 of the second terminal fastening part 30.

When the joining groove 28 is formed as described above, the second terminal fastening part 30 may be more easily coupled to and separated from the bobbin 20, as compared with the foregoing embodiments of the present invention.

Meanwhile, in the embodiment of the present invention, the case in which the joining groove 28 is formed above the first terminal fastening part 25 is described byway of example, but the joining groove 28 may be formed under the first terminal fastening part 25, on the flange part, and the like, and various applications may be implemented as needed.

Figure 7:
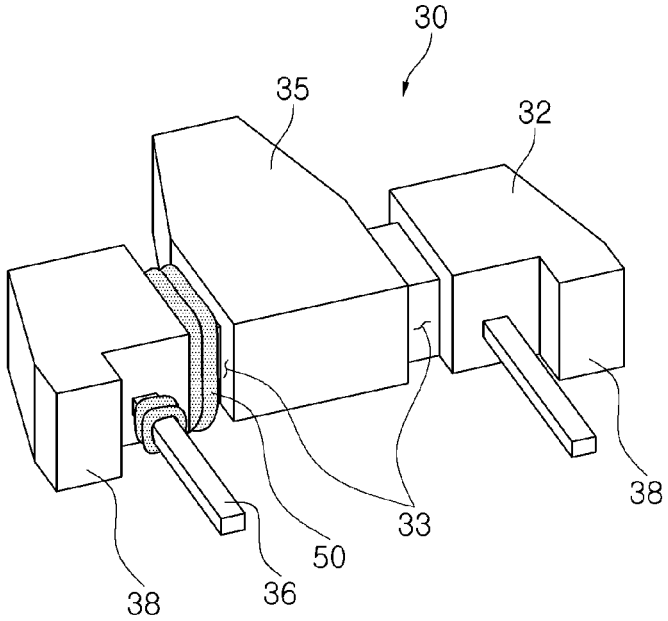
FIG. 7 is a perspective view showing a second terminal fastening part according to another embodiment of the present invention.

FIG. 7 is a perspective view showing a bobbin according to another embodiment of the present invention.

In the coil component according to the embodiment of the present invention, at least one winding groove 33 is formed in the terminal blocks 32 of the second terminal fastening part 30.

The winding grooves 33 around which the coils 50 are wound at least once before the coils 50 are wired to the second connection terminals 36, is provided to relatively more firmly wire the coils 50 with the second terminal fastening part 30. Meanwhile, for convenience of explanation, the shape in which the coils 50 are wound around only one winding groove 33 is shown in FIG. 7.

As the coils 50 are first wound around the winding grooves 33 and then, wired to the second connection terminals 36, the coils 50 are not easily released from the first connection terminals 26 even in a case in which the second terminal fastening part 30 is separated from the bobbin 20.

Further, the coils 50 are first wounded around the winding grooves 33 and then, wired to the second connection terminals 36, thereby significantly reducing the movement of the coils 50. Therefore, when the second terminal fastening part 30 is spaced apart from the bobbin 20, the coils 50 may be prevented from being folded or broken at a portion at which the second terminal fastening part 30 is wired to the second connection terminals 36 due to the movement of the second terminal fastening part 30.

In addition, when the amount of coils 50 wound around the auxiliary winding part 34 is insufficient, the coils 50 wound around the winding grooves 33 are released and thus, the length of the coils 50 may be extended.

In addition, in the second terminal fastening part 30 according to the embodiment of the present invention, the support protrusions 38 are disposed at the outside of the first connection terminals 26. In this case, the substrate 90 and the second terminal fastening part 30 may be more stably spaced apart from each other. However, the present invention is not limited thereto and a number of support protrusions 38 may be formed at various positions, as necessary.

Figure 8:
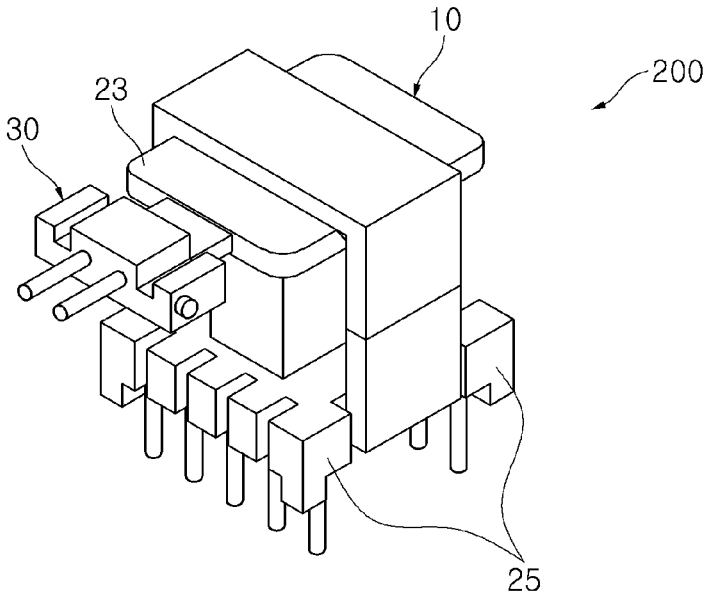
FIG. 8 is a perspective view schematically showing a coil component according to another embodiment of the present invention.

FIG. 8 is a perspective view schematically showing a coil component according to another embodiment of the present invention, wherein the coils are omitted.

In a coil component 200 according to the embodiment of the present invention, the second terminal fastening part 30 is formed on the flange part 23 rather than on the first terminal fastening part 25.

Meanwhile, in the embodiment of the present invention, the case in which the second terminal fastening part 30 are protruded in a direction in which the flange part 23 is extended is described by way of example, but the present invention is not limited thereto. Accordingly, the second terminal fastening part 30 may be disposed at any position that does not hinder the winding of the coils as needed, such as disposing the second terminal fastening part 30 to be protruded upwardly of the flange parts 23.

Next, the mounting structure for the coil component according to the embodiment of the present invention will be described.

Figure 9:
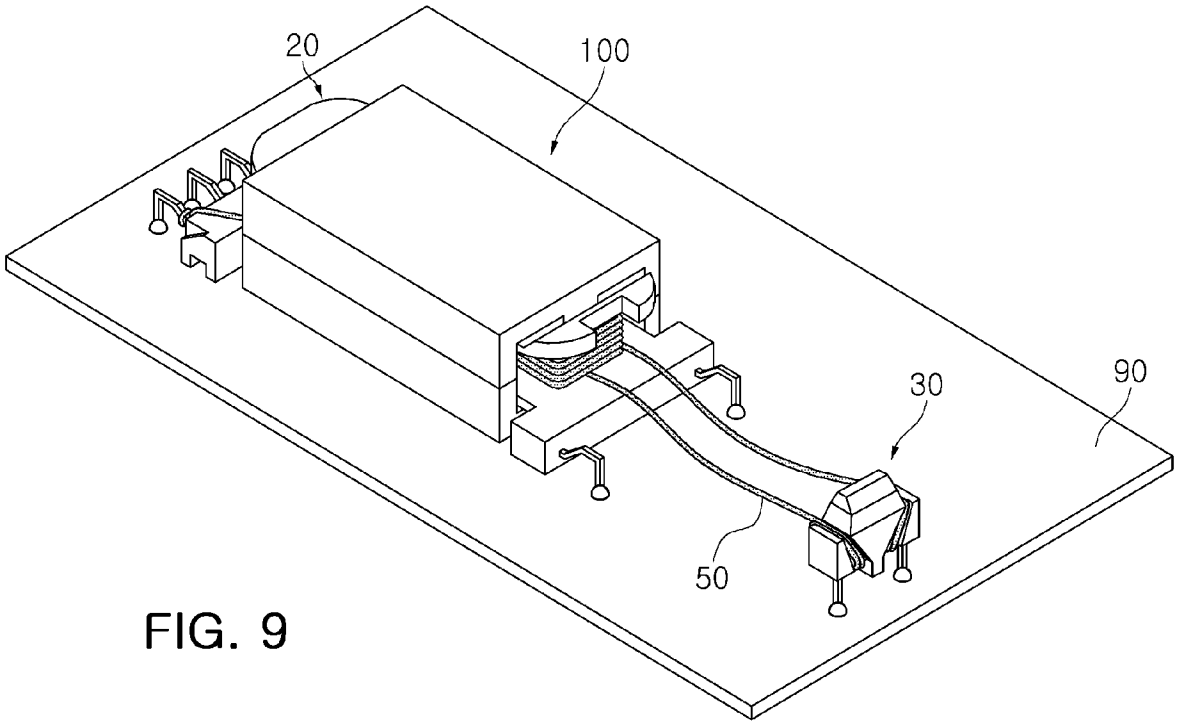
FIG. 9 is a partial perspective view showing a state in which the coil component according to the embodiment of the present invention is mounted on a substrate.

FIG. 9 is a partial perspective view showing a state in which the coil component according to the embodiment of the present invention is mounted on a substrate.

Referring to FIG. 9, in the mounting structure for the coil component according to the embodiment of the present invention, the bobbin 20 and the second terminal fastening part 30 may each mounted on the substrate 90 while being spaced apart from each other by a predetermined distance, that is, the insulating distance between the primary and secondary coils, or more.

The mounting structure may be implemented in a process of manufacturing the coil component 100 shown in FIG. 1 and then, first mounting the coil component 100 on the substrate 90, a process of separating the second terminal fastening part 30 from the mounted coil component 100, and a process of mounting the separated second terminal fastening part 30 on a position spaced by a predetermined distance from the bobbin 20.

In the mounting structure for the coil component according to the embodiment of the present invention, even with respect to a relatively small coil component, it may be connected to the substrate through the second terminal fastening part without being directly connected to the substrate using the coils or the wires extracted from the bobbin as in the related art.

That is, the coil component may only be mounted on the substrate by the process of bonding the bobbin and the second terminal fastening part on the substrate and then, bonding the substrate to the external connection terminal.

In addition, when the wires replace the external connection terminals as in the related art, there are defects in that the coils are wound manually and the coil component is mounted. In the coil component according to the embodiment of the present invention, the coils are wound in the state in which the second terminal fastening part is integrally coupled to the bobbin, such that the coils may be automatically wound by the auto winding equipment and the coil component may be automatically mounted on the substrate.

Therefore, according to the embodiments of the present invention, the working may be relatively very easy and the probability that defects occur during the component mounting process may be significantly reduced, as compared to the related art of directly mounting the wires or the coils on the substrate.

Meanwhile, the coil component according to the embodiment of the present invention is not limited to the foregoing embodiments and therefore, various applications may be implemented.

For example, the case in which the coil component is provided in a charger or a power supply apparatus according to the embodiment of the present invention is described byway of example, but the present invention is not limited thereto.

In addition, the embodiments of the present invention describe, by way of example, the transformer, but the present invention is not limited thereto and may be widely applied to all the coil components including the core and the coils.

As set forth above, in the coil component according to the embodiments of the present invention, the second terminal fastening part cut from the bobbin may be mounted on the substrate while being spaced apart from the bobbin by a predetermined distance (the insulating distance between the primary and secondary coils, or more). Therefore, the insulating distance between the primary and secondary coils may be easily secured even in the case in which the coil component is manufactured in a small size.

In addition, even in a case in which the coil component according to the embodiment of the present invention is a small coil component, as in the related art, the coils or the wires are not directly connected to the substrate by being extracted from the bobbin but are connected to the substrate through the second terminal fastening part. That is, the coil component may be mounted on the substrate only by the process of coupling the bobbin and the second terminal fastening part on the substrate to bond the substrate to the external connection terminals.

Further, in the coil component according to the embodiments of the present invention, the coils are wound in the state in which the second terminal fastening part is integrally coupled to the bobbin, and therefore, the coils are automatically wound by the auto winding equipment and the coil component may be automatically mounted on the substrate.

Therefore, the embodiments of the present invention may facilitate the working and significantly reduce the probability of occurrence of defects during the component mounting process, as compared to the related art of directly mounting the wires or the coils on the substrate.

While the present invention has been shown and described in connection with the embodiments, it will be apparent to those skilled in the art that modifications and variations can be made without departing from the spirit and scope of the invention as defined by the appended claims.

What is claimed is:

1. A coil component, comprising:

a bobbin including a winding part around which coils are wound and first terminal fastening parts fastened to a plurality of first connection terminals; and a second terminal fastening part including terminal blocks protruding from the bobbin and a plurality of second connection terminals fastened to the terminal blocks, the second terminal fastening part being separated from the bobbin after the coils are wound therearound, wherein the second terminal fastening part includes an auxiliary winding part connecting the terminal blocks to the bobbin, and the auxiliary winding part has the coils wound therearound to electrically connect the bobbin to the second connection terminals when the second terminal fastening part is spaced apart from the first terminal fastening parts.

2. The coil component of claim 1, wherein the auxiliary winding part has a reduced cross sectional area toward the bobbin.

3. The coil component of claim 1, wherein the second terminal fastening part includes at least one support protrusion protruded from the terminal blocks to space a substrate and the terminal blocks apart from each other when the second terminal fastening part is mounted on the substrate.

4. The coil component of claim 3, wherein the support protrusions are disposed between the second connection terminals.

5. The coil component of claim 1, wherein the terminal blocks are provided with at least one guide groove to guide the coils to the second connection terminals.

6. The coil component of claim 1, wherein the terminal blocks include at least one winding groove around which the coils are wound at least once to prevent a movement of the coils wired to the second connection terminals when the second terminal fastening part is spaced apart from the bobbin.

7. The coil component of claim 1, wherein the bobbin includes at least one locking protrusion protruded from a position adjacent to the second terminal fastening part, supporting the coils wired to the second terminal fastening part, and extending a path of the coils.

8. The coil component of claim 1, wherein the second terminal fastening part is integrally manufactured with the bobbin and is cut with external pressure to be separated from the bobbin.

9. The coil component of claim 8, wherein a portion in which the second terminal fastening part and the bobbin are connected to each other is provided with at least one cutting groove and is formed to have a cross sectional area smaller than those of portions adjacent to the cutting groove.

10. The coil component of claim 1, wherein the second terminal fastening part is separately manufactured from the bobbin to be coupled to the bobbin.

11. The coil component of claim 10, wherein any one of the second terminal fastening part and the bobbin includes at least one locking protrusion protruded to the outside and the other thereof includes at least one joining groove, and the second terminal fastening part and the bobbin are coupled to each other by inserting the locking protrusion into the joining groove.

12. The coil component of claim 1, wherein the second terminal fastening part is protruded from the first terminal fastening part of the bobbin.

13. The coil component of claim 1, wherein the winding part is formed of a tubular body part and flange parts extended from both edges of the body part, and the second terminal fastening part is protruded from any one of the flange parts.

14. A coil component, comprising:

a bobbin including a winding part around which coils are wound and first terminal fastening parts fastened to a plurality of first connection terminals; and a second terminal fastening part including terminal blocks with which second connection terminals are fastened, and an auxiliary winding part connecting the terminal blocks to the bobbin, an outside of the auxiliary winding part being provided with a portion of the coils, wherein the second terminal fastening part is separated from the bobbin and mounted on a substrate while being spaced apart from the first terminal fastening parts.

15. A mounting structure for a coil component, comprising:

a substrate; and a coil component including a bobbin that includes a winding part around which a plurality of coils are wound and first terminal fastening parts fastened to a plurality of first connection terminals, the bobbin being mounted on the substrate, and a second terminal fastening part mounted on the substrate while being spaced apart from the first terminal fastening parts, at least one of the coils being electrically connected to the substrate through the second terminal fastening part.

16. An electronic device, comprising:

a substrate; and a coil component including a bobbin that includes a winding part around which a plurality of coils are wound and first terminal fastening parts fastened to a plurality of first connection terminals, the bobbin being mounted on the substrate, and a second terminal fastening part mounted on the substrate while being spaced apart from the first terminal fastening parts, at least one of the coils being electrically connected to the substrate through the second terminal fastening part.

* * * * *